US006926137B2

(12) United States Patent
Rudnick et al.

(10) Patent No.: US 6,926,137 B2
(45) Date of Patent: Aug. 9, 2005

(54) UTENSIL STORAGE UNIT

(75) Inventors: Linda T. Rudnick, 2036-B N. Sedgwick, Chicago, IL (US) 60614; Edward Schamback, Prescott, AZ (US)

(73) Assignee: Linda T. Rudnick, Chicago, IL (US)

( * ) Notice: Subject to any disclaimer, the term of this patent is extended or adjusted under 35 U.S.C. 154(b) by 173 days.

(21) Appl. No.: 10/422,715

(22) Filed: Apr. 25, 2003

(65) Prior Publication Data

US 2003/0192798 A1 Oct. 16, 2003

Related U.S. Application Data

(63) Continuation-in-part of application No. 09/932,442, filed on Aug. 20, 2001, now Pat. No. 6,601,700.

(60) Provisional application No. 60/226,907, filed on Aug. 23, 2000.

(51) Int. Cl.[7] ..... B65D 85/00

(52) U.S. Cl. ..... 206/15.3; 206/349; 206/361; 206/804; 220/826

(58) Field of Search ..... D6/524; 4/255.05, 4/255.11; 190/11, 17; 206/209, 209.1, 361, 362.1, 362.2, 362.3, 349, 738, 751, 754, 755, 15.3, 804; 220/212, 529, 826

(56) References Cited

U.S. PATENT DOCUMENTS

| | | | | |
|---|---|---|---|---|
| 1,417,814 A | | 5/1922 | Fairweather | |
| 1,730,312 A | | 10/1929 | Bravo | |
| 2,637,614 A | | 5/1953 | Simos | |
| 2,757,787 A | | 8/1956 | Sergent | |
| 2,994,453 A | | 8/1961 | Gardiner | |
| 3,083,859 A | | 4/1963 | Gardiner | |
| 3,713,529 A | * | 1/1973 | Meksula | 312/272 |
| 3,877,600 A | | 4/1975 | Beil | |
| 4,603,791 A | | 8/1986 | Spierer et al. | |
| 4,679,700 A | | 7/1987 | Tharrington et al. | |
| 5,836,322 A | | 11/1998 | Borger et al. | |
| 5,924,566 A | | 7/1999 | Gibbs | |
| 5,958,150 A | | 9/1999 | Borger et al. | |
| 6,035,456 A | | 3/2000 | Taylor | |
| 6,038,709 A | | 3/2000 | Kent | |

* cited by examiner

*Primary Examiner*—Jim Foster
(74) *Attorney, Agent, or Firm*—Nixon Peabody LLP

(57) ABSTRACT

A storage unit for storing a utensil having a handle portion and head portion, the storage unit including a container having a bottom wall and sidewalls connected to the bottom wall to define a chamber, a pair of opposed container closure units pivotably connected to the container sidewalls for movement between an open position exposing the chamber and a closed position closing the chamber from the outside environment; a utensil holder sized to receive the head portion of the utensil, a support platform for connection to the utensil holder, the support platform being movably positioned in the chamber between a first position away from the bottom wall and a second position towards the bottom wall, and a mechanism for pivotably biasing the container closure units to the open and closed positions, the mechanism being connected at a first end to the support platform and a second end to each container closure unit. The container closure units are adapted to pivotably move to the open position in response to movement of the support platform to the first position and to the closed position in response to movement of the support platform to the second position.

16 Claims, 3 Drawing Sheets

UTENSIL STORAGE UNIT

This application is a continuation-in-part of application Ser. No. 09/932,442 filed Aug. 20, 2001, U.S. Pat. No. 6,601,700, which is based upon provisional patent application Ser. No. 60/226,907, filed Aug. 23, 2000.

TECHNICAL FIELD

The present invention relates to a storage unit for a utensil such as a toilet brush or a plumbing plunger, and more particularly to an enclosed storage unit with spring biased closures which are operated by a support platform.

BACKGROUND OF THE INVENTION

Conventional bathroom utensils such as toilet brushes and plumbing plungers are normally used in unsanitary environments, and even though the respective heads of the toilet brush and plumbing plunger are rinsed after use, it is desirable to enclose the heads between uses. This permits the plunger head or the brush head to dry without contacting and possibly contaminating surrounding objects.

The storage of a plunger or brush head within an enclosure device is not without some significant problems. First, it is desirable to effectively operate a device which encloses the plunger head without requiring manual contact with either the enclosing device or the plunger head.

Next, the enclosure device and mechanisms within the enclosure device should be formed to facilitate easy and effective cleaning. Internal mechanisms with irregular surfaces and shapes which are difficult to clean should be eliminated.

Finally, the number of mechanisms within the enclosure device must be minimized and the mechanisms kept simple to ensure effective cleaning and long use.

SUMMARY OF THE INVENTION

It is a primary object of the present invention to provide a novel and improved utensil storage unit and more specifically an improved plunger or brush storage unit for enclosing the plunger or brush head of a plumbing plunger or toilet brush which may be effectively operated without requiring manual contact with either the plunger or brush head or the plunger or brush storage unit.

Yet another object of the present invention is to provide a novel and improved plunger or brush storage unit wherein the plunger or brush head for a plumbing or brush plunger is supported by a platform within an enclosure and the handle for the plunger or brush projects through an opening in closure units for the enclosure.

Another object of the present invention is to provide a novel and improved plunger or brush storage unit having spring biased closures which are biased in a first direction to positively close the plunger or brush storage unit and are held closed by spring bias and which are snapped open and held open by spring bias in a second direction opposite to said first direction.

A further object of the present invention is to provide a novel and improved plunger or brush storage unit which employs two single strand spring members to both mount a plunger or brush support platform and operate opposed closure units for the plunger or brush storage unit.

A still further object of the present invention is to provide a novel and improved plunger or brush storage unit including a plunger or brush head container having opposed sidewalls and a bottom wall to define an open ended enclosure. The open end of the enclosure is opened and closed by two opposed closure units pivotally mounted on opposed sidewalls of the plunger or brush head container. A plunger or brush support platform is suspended from the opposed closure units by spring arm platform supports which permit the platform to move toward the container bottom to close the closure units across the open end of the container to a closed position and away from the container bottom to open the closure units to an open position. The spring arm platform supports are formed to bias the closure units toward the closed position and to bias the closure units toward the open position before the platform reaches the extent of its travel toward or away from the bottom of the container. In the case of a toilet brush container, a receptacle may be provided on the platform to support the brush in an upright position.

DESCRIPTION OF THE PREFERRED EMBODIMENTS

Figure 1:
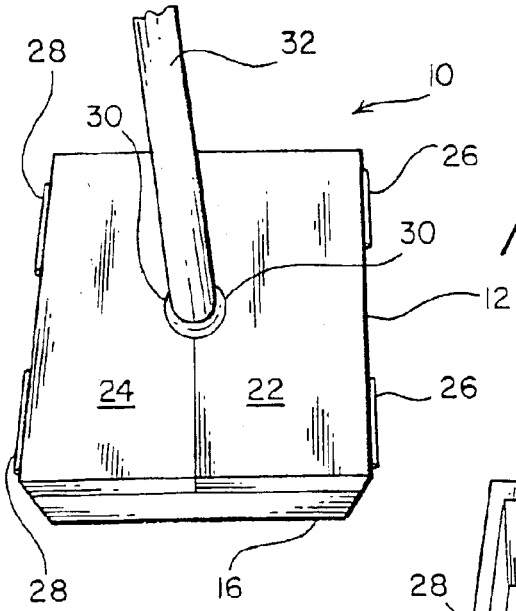
FIG. 1 is a perspective view of a storage unit, and more particularly, a plunger storage unit of the present invention in the full closed position.

The storage unit 10 of the present invention which is readily adapted to hold and support a variety of utensils, is illustrated. Particularly, the storage unit 10 includes a plunger head container 12 having a bottom wall 14 which engages sidewalls 16 to define a chamber 18 having an open end 20. This open end is selectively closed by two opposed closure units 22 and 24, each of which is hingedly connected for pivotal movement by hinges 26 and 28 connected respectively to opposed sidewalls 16. The closure units may be pivoted to meet at a closed position across the open end 20, and the free edge of each closure unit is formed with an arcuate cutout portion 30. In the closed position, the arcuate cutout portions of the closure units 22 and 24 form a circular opening to receive the handle 32 of a plumbing plunger having a plunger head 34 which is received in the chamber 18. Each closure unit has an endwall 21, spaced opposed sidewalls 23 and a topwall 25. The endwall 21 is hinged to a sidewall 16.

Figure 3:
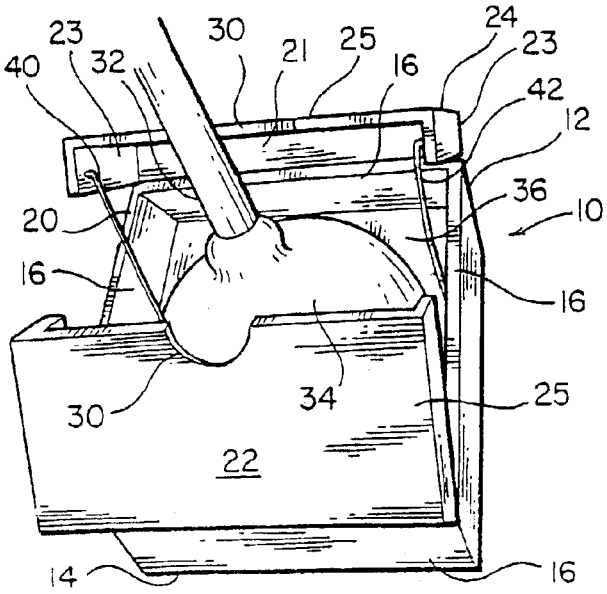
FIG. 3 is a perspective view of the plunger storage unit of FIG. 1 between the full open and full closed positions.
Figure 4:
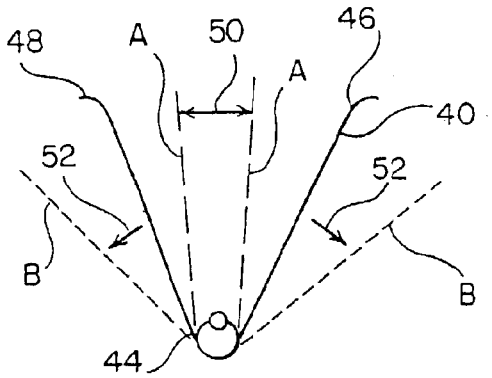
FIG. 4 is a diagrammatic view of the spring arm platform supports used in the plunger storage unit of the present invention.

Suspended within the chamber 18 for movement toward and away from the bottom wall 14 is a plunger head supporting platform 36 having a centrally located opening 38. The supporting platform, container 12, and opposed closure units 22 and 24 are formed of a material which can be easily cleaned by immersion, such as molded hard plastic material. The supporting platform 36 is suspended by two spaced opposed, substantially U shaped spring arm platform supports 40 and 42, each of which has one end connected to the forward portion of the sidewall 23 of closure unit 22 and the opposite end connected to the forward portion of the sidewall 23 of closure unit 24. Each spring arm platform support is secured to a pin 37 on the underside of the platform by a central section between the legs 46 and 48 of the spring arm platform support as indicated in the dotted lines at 44. These spring arm platform supports are preferably each formed from a single, elongate strand of spring metal and have an intermediate position shown in FIG. 3 and in solid lines in FIG. 4. In this intermediate position, the spring arm platform supports do not bias the closure units 22 and 24 in either the open or closed direction. However, when a plunger on the platform 36 is pushed toward the bottom wall 14 causing the closure units 22 and 24 to pivot toward the closed position as the platform 36 moves toward the bottom wall 14, the legs 46 and 48 of the spring arm platform supports will begin to move together. These legs are of substantially equal length, and once they pass the intermediate position shown in solid lines in FIG. 4, they become biased in the direction of the arrows 50, and this bias remains to hold the closure units tightly closed when the platform reaches the lowermost position. With the platform in the lowermost position, the platform will be suspended by the spring arm platform supports in spaced relation to the bottom wall 14, and the spring arm platform supports will be positioned as shown by the broken lines A in FIG. 4.

To open the plunger storage unit 10, the handle 32 is raised upwardly causing the plunger head 34 to raise off the platform 36 and engage the closure units 22 and 24. As the closure units are forced open by the plunger head, the platform moves upwardly away from the bottom wall 14 and the legs 46 and 48 of the spring arm platform supports begin to move apart. Once the legs pass the intermediate position, the bias changes to the direction of the arrows 52 and the closure units are snapped to the full open position shown in FIG. 2. In the full open position, the bias in the direction of the arrows remains to hold the platform and the closure units in the position shown in FIG. 2, and the legs of the spring arm platform supports will be in the broken line position B in FIG. 4.

To again enclose the plunger head 34, the plunger head is placed on the platform 36, and will be supported with the closure units in the open position by the bias in the direction of the arrows 52. Downward pressure on the plunger head caused by pressure applied to the handle 32 will overcome this bias and the platform moves toward the bottom wall 14 to close the closure units 22 and 24.

The spring arm platform supports 40 and 42 provide the multiple functions of movably supporting the platform 36, opening and closing the closure units 22 and 24 and biasing the closure units in either the open or tightly closed positions. All of this is accomplished by two elongate strands of shaped spring metal which minimize the number of operable components present within the chamber 18. These preferably round, spring metal wire strands can be easily wiped clean and provide a minimal surface area for contamination, yet they permit the platform and closure units to be effectively operated by manual contact with only the plunger handle.

Figure 5:
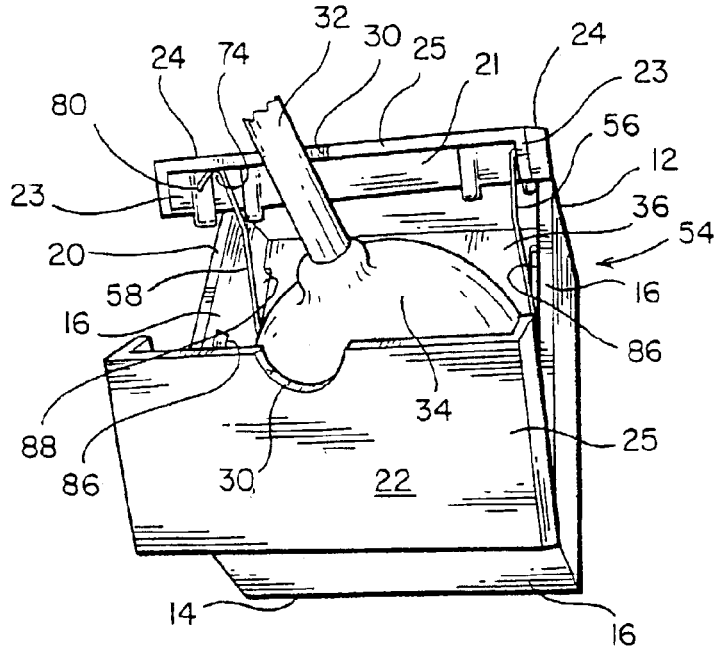
FIG. 5 is a perspective view of a second embodiment of the plunger storage unit of the present invention between the full open and full closed positions.
Figure 6:
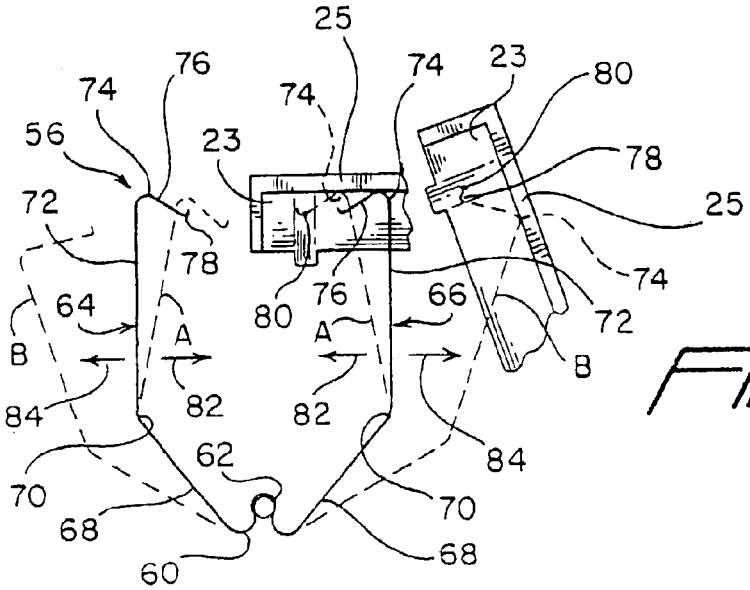
FIG. 6 is a diagrammatic view of the spring arm platform supports used in the plunger storage unit of FIG. 5.

Referring now to FIGS. 5 and 6, a second embodiment of the plunger storage unit is indicated generally at 54. In FIGS. 5 and 6, structural elements which are the same as those previously described in connection with FIGS. 1–4 will be designated by the reference numerals used in connection with FIGS. 1–4.

Figure 2:
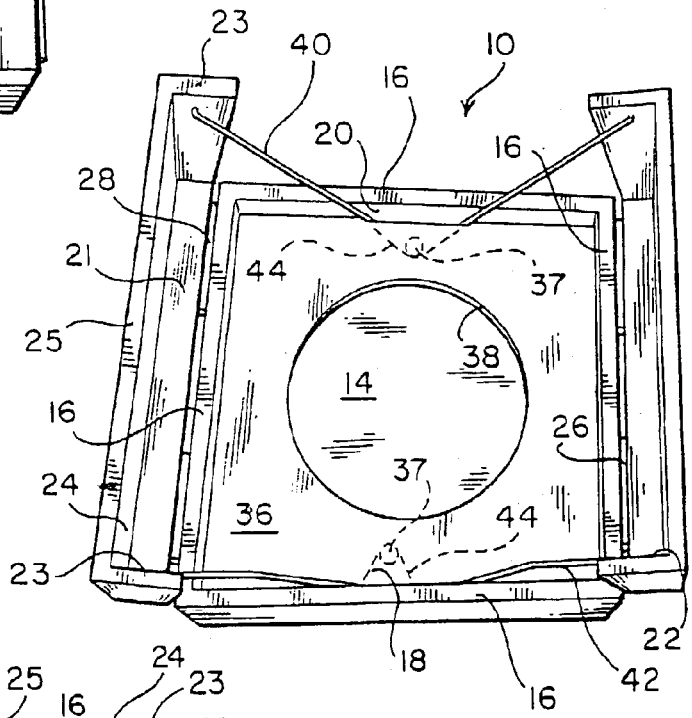
FIG. 2 is a perspective view of the plunger storage unit of FIG. 1 in the full open position.

As shown in FIG. 2, the plunger storage unit 54 includes a platform 36 supported by two opposed spring arm platform supports on opposite sides of the platform which are each connected to the sidewalls 23 of the closure units 22 and 24. However, spring arm platform supports 56 and 58 of the plunger storage unit 54 are configured differently from the spring arm platform supports 40 and 42.

Both spring arm platforms supports 56 and 58 are formed in the same manner which will be described with relation to the spring arm platform support 56 in FIG. 6. This spring arm platform support is preferably formed from a single strand of spring metal, such as a flexible wire strand, and has a central section 60 which projects laterally and terminates in a loop 62. The central section engages the underside of the platform 36 and the loop fits over a pin 37 on the platform underside.

From the central section 60 two opposed legs 64 and 66 of substantially equal length extend upwardly. Each opposed leg includes a first leg section 68 which angles outwardly from the central section 60 and terminates at a flexible joint 70. From the flexible joint 70, each opposed leg includes a second leg section 72 which extends upwardly and moves about the joint 70. The second leg section terminates at a juncture 74 with a lateral section 76 which extends upwardly toward the opposite leg at substantially a 90° angle to the second leg section. The lateral section 76 terminates in an outwardly extending pin 78 which engages a pin receiving aperture 80 in the sidewall 23 of each closure unit. The first leg sections of the legs 64 and 66 are of substantially equal length as are the second leg sections 72.

The spring arm platform supports 56 and 58 have an intermediate position shown in solid lines in FIG. 6 where the spring arm platform supports do not bias the closure units 22 and 24 in either an open or a closed direction. It will be noted that in this intermediate position, as shown in FIG. 5, the juncture 74 between the lateral section 76 and the second leg section 72 is in engagement with the underside of the topwall 25 for each closure unit. As a plunger on the platform 36 is pushed downwardly to move the platform toward the bottom wall 14, the closure units 22 and 24 are pulled downwardly about the hinges 26 and 28. The juncture 74 of each leg engages the top wall 25 of each closure unit to which each spring arm platform support is attached and forces the second leg section 72 for each leg 64 and 66 to pivot inwardly about the flexible joints 70. As the second leg sections pass inwardly past the solid line position shown in FIG. 6, they create a bias in the direction of the arrows 82 which biases the closure units 22 and 24 in the closed position when the second leg sections reach the dotted line position A. In this position, the platform 36 is supported in spaced relationship above the bottom wall 16.

To open the closed closure units 22 and 24, the handle 32 of the plunger is raised upwardly causing the plunger head 34 to engage and pivot the closure units upwardly about the hinges 26 and 28.

As the closure units are forced open by the plunger head, the platform 36 is drawn upwardly by the spring arm platform supports 56 and 58 away from the bottom wall 14. The legs 64 and 66 of each spring arm platform support 56 and 58 begin to move outwardly from the dotted line position A in FIG. 6. Initially, the second leg sections pivot outwardly about the flexible joints 70, but as the legs pass outwardly beyond the solid line position in FIG. 6, the first leg sections 68 pivot outwardly from the central section 60 as the second leg sections continue to pivot outwardly from the flexible joints 70. As the closure units continue to open, the legs 64 and 66 move outwardly beyond the solid line intermediate position of FIG. 6, and the direction of bias created by the legs reverses to the direction of the arrows 84. When the closure units are fully opened and the platform is in the uppermost position, the legs 64 and 66 are in the broken line position shown at B in FIG. 6 and they bias the closure units open. The closure units are positively held open by the contact between the juncture 74 and the top wall 25 of each closure unit. It will be noted that inwardly projecting flanges 86 formed adjacent to the upper edges of the sidewalls 16 engage the platform 36 to retain the platform within the confines of the sidewalls when the closure units are biased to the fully open position.

When the closure units 22 and 24 are fully open, the spring arm platform supports 56 and 58 are fully expanded as shown at B in FIG. 6. To permit the spring arm platform supports to expand and contract freely, opposed edges of the platform 36 are cut away at 88 to receive and facilitate operation of the spring arm platform supports.

To close the fully open closure units 22 and 24, a plunger head 34 is positioned on the platform 36 and the handle 32 is pressed downwardly to force the platform toward the bottom wall 14. The spring arm platform supports 56 and 58 now pivot inwardly from the broken line position B and draw the closure units downwardly about the hinges 26 and 28. It will be noted that the back wall 21 and the sidewalls 23 of each closure unit are provided with downwardly projecting guides 90 which engage the inner surface of the sidewalls 16 to insure that the closure units are aligned in the closed position over the open end 20 of the chamber 18.

Figure 7:
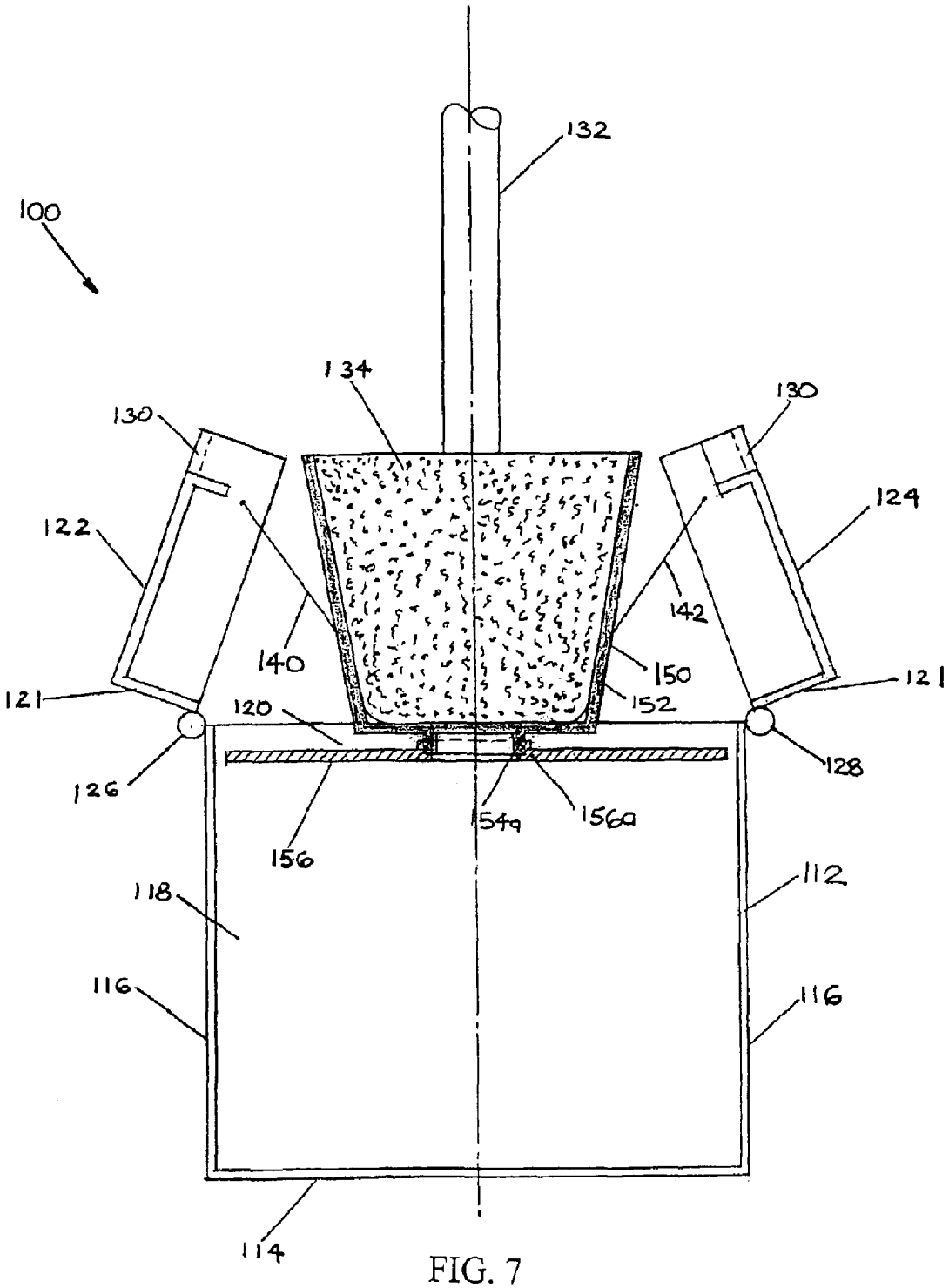
FIG. 7 is a side view of a third embodiment of a storage unit, and more particularly, a toilet brush storage unit of the present invention in the open position.

FIG. 7 shows a third embodiment of a storage unit 100 for storing a utensil and includes a container 112 having a bottom wall 114 and sidewalls 116 which define a chamber 118 having an open end 120. The unit 100 also includes two opposed closure units 122 and 124 hingedly connected to the sidewalls 116 for pivotal movement between an open position exposing the chamber 118 to the outside environment and a closed position closing the chamber 118 from the outside environment. Each closure unit 122 and 124 has an endwall 121 that serves as a point of connection between each closure unit 122 and 124 and its respective sidewall 116. When the closure units 122 and 124 are moved to the closed position, the free edge portion of each closure unit 122 and 124 is formed with a cutout portion 130. In the closed position, the cutout portions 130 of the closure units 122 and 124 form an opening to receive a handle 132 of the bathroom accessory, which in this embodiment is a toilet brush head 134 composed of a plurality of bristles connected to the handle 132 and which are received in the chamber 118. While it is preferred that the container 112 has a rectangular shape, the container 112 may be of any known shape that permits storage of a utensil. Both the container 112 and the closure units 122 and 124 are preferably composed of a polymeric material.

Suspended within the chamber 118 for movement towards and away from the bottom wall 114 is a cup-shaped holder 150 and a supporting platform 156 releaseably connected to the holder 150 for movement between a first position away from the bottom wall 114 and a second position towards the bottom wall 114. The holder 150 may take on any configuration, but in this case is generally cylindrical in shape and includes a sidewall 152 that engages a base portion 154 to define a chamber sized to receive the brush head 134. The outer surface of the base portion 154 is provided with outer threads 154*a* which mate with corresponding inner threads 156*a* of the platform 156 to form a releasable connection between the holder 150 and the platform 156. While it is preferred that the holder 150 has a cylindrical shape, the holder 150 may be of any shape that permits the receipt of the working section of the utensil. Both the holder 150 and the supporting platform 156 are preferably composed of a polymeric material.

The holder 150 is suspended by two spaced opposed, substantially U shaped spring arm platform supports 140 and 142, each of which has one end connected to the forward portion of a sidewall portion of a respective closure unit 122 and 124 and an opposite end connected to the supporting platform 156. Each spring arm platform support 140 and 142 is secured to a pin 37 on the underside of the platform 156 by a central section between the legs 146 and 148 of the spring arm platform support 140 and 142 as indicated in the dotted lines at 144. While, the spring arm platform supports 140 and 142 are preferably composed of the same material and function in the same manner as those previously described in the first embodiment, they may alternatively take the form and function of the spring arm platform supports described in the second embodiment.

To open the plunger storage unit 100, the handle 132 is raised upwardly causing the brush head 134 to move from the rest position raise away from the platform 156 and engage the closure units 122 and 124. As the closure units 122 and 124 are forced open by the brush head 134, the platform 136 moves upwardly away from the bottom wall 114 and the spring arm platform supports 140 and 142 begin to move apart. To again enclose the brush head 134, the brush head 134 is inserted into the holder 150, and will be supported in the open position by the closure units 122 and 124. Downward pressure to the handle 132 overcomes the bias of the spring arm platform supports 140 and 142 and the holder 150 and the platform 156 jointly move toward the bottom wall 114 to close the closure units 122 and 124.

Although exemplary embodiments of the present invention have been described in detail herein, it should be appreciated by those skilled in the art that many modifications are possible without materially departing from the spirit and scope of the teachings and advantages which are described herein. Accordingly, all such modifications are intended to be included within the spirit and scope of the present invention.

We claim:

1. A storage unit for storing a utensil having a handle portion and head portion, said storage unit comprising:

a container having a bottom wall and sidewalls connected to said bottom wall to define a chamber;

a pair of opposed container closure units pivotally connected to said container sidewalls for movement between an open position exposing said chamber and a closed position closing said chamber from the outside environment;

a utensil holder sized to receive the head portion of the utensil;

a support platform for connection to said utensil holder, said support platform being movably positioned in said chamber between a first position away from said bottom wall and a second position towards said bottom wall; and spaced platform support units connected between said platform and said container closure units to suspend said platform from said container closure units, said platform support units being connected to pivot said container closure units toward the closed position when said platform is moved toward said bottom wall and to move said platform away from said bottom wall when said container closure units are pivoted toward the open position to open said container.

2. The storage unit of claim 1 wherein said platform support units is movable between a first flexing position to bias said container closure units to said closed position and a second flexing position to bias said container closure units to said open position.

3. The storage unit of claim 1 wherein each of said platform support units includes a first leg connected between said platform and the first container closure unit and a second leg connected between said platform and the second container closure unit.

4. The storage unit of claim 2 wherein each of said platform support units is formed from a single, elongate strand of material.

5. The storage unit of claim 3 wherein said platform support units is movable between a first flexing position to bias said container closure units to said closed position and a second flexing position to bias said container closure units to said open position.

6. The storage unit of claim 3 wherein said first and second legs of each platform support unit are formed of flexible material, said first and second legs being formed to flex toward one another when said platform moves toward said bottom wall to move said container closure units to the closed position and bias said container closure units toward said bottom wall in the closed position, said first and second legs being formed to flex away from one another when said container closure units are pivoted toward the open position to move said platform away from said bottom wall and bias said container closure units away from said bottom wall in the open position thereof.

7. The support unit of claim 6 wherein each of said platform support units is formed from a single, elongate strand of flexible material.

8. The support unit of claim 6 wherein each of said platform support units is formed from a strand of flexible metal wire.

9. The support unit of 8 wherein the first and second legs of each of said platform support units are joined by a central section that is secured beneath said platform.

10. The support unit of claim 9 wherein said container and said closure units are formed of molded plastic.

11. The storage unit of claim 3 wherein said first and second legs each include a first elongate section which angles upwardly and laterally outwardly from a connection with said platform, each first elongate section being connected to a second elongate leg section by a flexible joint, said second elongate leg section of said first leg being connected to said first container closure unit and the second elongate leg section of said second leg being connected to said second container closure unit.

12. The storage unit of claim 11 wherein said first and second legs of each platform support unit are formed of flexible material, said first and second legs being formed to flex toward one another when said platform moves toward said bottom wall to move said closure units to the closed position and bias said closure units toward said bottom wall in the closed position, said first and second legs being formed to flex away from one another when said closure units are pivoted toward the open position to move said platform away from said bottom wall and bias said closure units away from said bottom wall in the open position thereof.

13. The storage unit of claim 11 wherein said first and second elongate leg sections flex at said flexible joint.

14. The support unit of claim 13 wherein each of said platform support units is formed from a single, elongate strand of flexible material.

15. The support unit of 14 wherein the first and second legs of each of said platform support units are joined by a central section that is secured beneath said platform.

16. A storage unit for storing a toilet brush having a handle portion and head portion, said storage unit comprising:

a container having a bottom wall and sidewalls connected to said bottom wall to define a chamber, a pair of opposed container closure units pivotably connected to said container sidewalls for movement between an open position exposing said chamber and a closed position closing said chamber from the outside environment;

a brush holder sized to receive the head portion of the toilet brush;

a support platform for connection to said brush holder, said support platform being movably positioned in said chamber between a first position away from said bottom wall and a second position towards said bottom wall; and spaced platform support units connected between said platform and said container closure units to suspend said platform from said container closure units, said platform support units being connected to pivot said container closure units toward the closed position when said platform is moved toward said bottom wall and to move said platform away from said bottom wall when said container closure units are pivoted toward the open position to open said container.

* * * * *